US005714017A

United States Patent [19]

Tomida et al.

[11] Patent Number: 5,714,017

[45] Date of Patent: Feb. 3, 1998

[54] MAGNETIC STEEL SHEET HAVING EXCELLENT MAGNETIC CHARACTERISTICS AND BLANKING PERFORMANCE

[75] Inventors: Toshiro Tomida; Shigeo Uenoya, both of Osaka, Japan

[73] Assignee: Sumitomo Metal Industries, Ltd., Osaka, Japan

[21] Appl. No.: 640,054

[22] Filed: Apr. 30, 1996

[30] Foreign Application Priority Data

May 2, 1995 [JP] Japan ..... 7-108483

[51] Int. Cl.[6] ..... H01F 1/14

[52] U.S. Cl. ..... 148/308; 428/610

[58] Field of Search ..... 148/307, 308; 420/117; 428/610

[56] References Cited

FOREIGN PATENT DOCUMENTS

| | | |
|---|---|---|
| 1-108345 A | 4/1989 | Japan . |
| 2-209455 A | 8/1990 | Japan . |
| 7-173542 A | 7/1995 | Japan . |
| WO 95/12691 | 5/1995 | WIPO . |

*Primary Examiner*—John Sheehan

*Attorney, Agent, or Firm*—Burns, Doane, Swecker & Mathis, LLP

[57] ABSTRACT

A magnetic steel sheet containing, on a weight basis, 0.2 to 6.5% of Si and 0.03 to 2.5% of Mn, having a crystallographic texture wherein the density of aggregation of {100} planes parallel to the surface of the sheet is not less than 10 times that of non-oriented crystal grains, and having a demanganized layer in which the concentration of manganese decreases from the interior of the sheet toward the surface of the sheet, wherein the ratio between the concentration of manganese in the surface portion of the sheet and that in the mid depth portion of the sheet is not more than 0.90 and wherein the maximum ratio of reduction in the concentration of manganese within the demanganized layer is not more than 0.05 wt %/μm. Magnetic characteristics of the magnetic steel sheet improved by adopting the average grain diameter 0.25 to 10 times the thickness of the sheet and by applying to the sheet a tension smaller than the elastic limit of the sheet in a direction parallel to the surface of the sheet. By employing an appropriate ratio of reduction in the Mn concentration, a relatively high magnetic flux density is obtained without a sharp increase in magnetic flux density, and core loss reduces, thereby providing a non-oriented or doubly oriented magnetic steel sheet having excellent magnetic characteristics and blanking performance.

20 Claims, 5 Drawing Sheets

T1 : {100} <021>

T2 : {100} <001>

MAGNETIC STEEL SHEET HAVING EXCELLENT MAGNETIC CHARACTERISTICS AND BLANKING PERFORMANCE

BACKGROUND OF THE INVENTION

1. Field of the Invention

The present invention relates to a method of manufacturing a magnetic steel sheet having crystallographic texture wherein {100} planes parallel to the surface of the sheet densely. Particularly, the invention relates to a non-oriented or doubly oriented magnetic steel sheet wherein {100} planes parallel to the surface of the sheet densely and wherein the concentration of manganese in a demanganized surface layer decreases at an appropriate ratio in the direction of thickness of the sheet, thereby providing excellent magnetic characteristics and blanking performance.

2. Description of the Prior Art

Magnetic steel sheets have conventionally been used as magnetic core materials for electric motors, generators, transformers, etc. A magnetic steel sheet requires two major properties: a reduced magnetic energy loss in AC magnetic fields and a high flux density in magnetic fields. These characteristics are effectively achieved by enhancing the electric resistance of the sheet, and in addition, by causing its axis of easy magnetization, the <001> axis of the bcc lattice, to have the same orientation as the direction of the magnetic field in which the sheet is used.

Singly oriented magnetic steel sheets are typical ones where their <001> axes are oriented in the direction of the magnetic field in which they are used.

Since they exhibit remarkable magnetic characteristics when their <001> axes are oriented in the direction of rolling and they are used in a magnetic field applied in the direction of rolling, they provide good magnetic characteristics when they are used with transformers or like equipment in which the magnetic field is applied singly. However, they do not provide desired effects when used, for example, in a motor whose magnetic field is applied omnidirectionally or in an EI core whose magnetic field is applied doubly.

FIG. 6(*a*) schematically shows crystallographic texture where <001> axes of crystal grains are not oriented or are oriented in various directions, and FIG. 6(*b*)schematically shows crystallographic texture where <001> axes of crystal grains are oriented in two directions. Magnetic steel sheets having the crystallographic texture of FIG. 6(*a*) are most suited for use in motors or like equipment. The crystallographic texture as shown in FIG. 6(*a*) requires densely aggregating {100} planes parallel to the surface of the sheet. By contrast, most suited for EI cores or like equipment are magnetic steel sheets having the {100} <001> crystallographic texture shown in FIG. 6(*b*) where their <001> axes are aligned in two directions. The crystallographic texture of FIG. 6(*b*) also requires densely aggregating {100} planes parallel to the surface of the sheet.

In the present specification, the expression "{100} planes parallel to the surface of the sheet" refers to {100} planes which are inclined not more than 5° relative to the surface of the sheet. Crystallographic orientation of crystal grains relative to the surface of the sheet can be analyzed by observing electron channeling pattern (EPC) using a scanning electron microscope (SEM). Also herein, the expression "the density ratio of {100} planes parallel to the surface of the sheet" refers to value Q indicative of $[(s/S)+(s_0/S_0)]$ where s is the total area of grains observed to have {100} planes parallel to the surface of the sheet, S is the total area of all observed crystal grains, and $s_0$ and $S_0$ denote s and S, respectively, when crystal grains are not oriented (random orientations). The expression "{100} planes parallel to the surface of the sheet densely" means that Q is not less than 10.

The below described methods are known for manufacturing magnetic steel sheets where {100} planes parallel to the surface of the sheet.

(1) UTILIZING SOLIDIFIED TEXTURE

(i) Utilizing a Molten Metal Quenching

Molten metal quenching is a method of directly casting a steel sheet having a thickness of 0.05 mm to 0.5 mm where molten metal is allowed to flow onto the surface of a cooling roll rotating at high speed. When the molten metal is silicon steel containing 2.0 to 6.0% of Si, the thus cast steel sheet has a columnar grain texture having {100} planes parallel to the surface of the sheet. The thus obtained magnetic steel sheet, however, has a relatively small magnetic flux density and a relatively large core loss due to a relatively small density aggregate of {100} planes parallel to the surface of the sheet. Also, due to surface roughness and poorly achieved thickness precision, a space factor is not satisfactory when the sheets are layered on top of one another.

(ii) Utilizing {100} Fibrous Texture Formed of Columnar Crystals of Ingot

An ingot having columnar crystal grains is rolled such that {100} planes of columnar crystal grains become parallel to the rolled surface, followed by annealing at not less than 1000° C. In the thus obtained steel sheet, however, the density of aggregation of {100} planes is relatively low.

(2) UTILIZING SURFACE ENERGY

A magnetic steel sheet having a thickness of not more than 0.15 mm is annealed at not less than 1000° C. in a weakly oxidizing atmosphere. This causes crystal grains to grow to a size substantially equal to the thickness of the sheet. Subsequently, crystal grains having their {100} planes parallel to the surface of the sheet grow dominantly using the surface energy as a driving force. However, when this method is used for enhancing the density of aggregation of {100} planes parallel to the surface of the sheet, crystals grow to a size 10 to 100 times the sheet thickness, resulting in an increased eddy current loss. This method is intended for steel sheets having a thickness not more than 0.15 and thus is not suited for manufacturing magnetic steel sheets which for industrial purposes are required to have a thickness not less than 0.2 mm.

(3) UTILIZING CROSS ROLLING

When silicon steel containing a trace amount of A1N is cross rolled and then undergoes final annealing at 1150° C., {100} <001> grains recrystallize. However, as the density of aggregation of {100} <001> crystal grains increases, the crystal size increases to 10 to 100 times the thickness of the sheet, resulting in increased eddy current loss. Also, cross rolling is not applicable to elongated materials because cross rolling is performed in a direction perpendicular to the length of a steel sheet, i.e. a steel sheet is turned 90° and then rolled.

(4) METHOD DISCLOSED IN JAPANESE PATENT APPLICATION LAID-OPEN (KOKAI) NO. 53-31515

A steel sheet substantially not containing C is heated to an austenite single-phase temperature zone and then cooled gradually. During the gradual cooling, a texture having aggregated {100} planes parallel to the surface of the sheet grows due to an austenite-to-ferrite transformation (hereinafter referred to as $\gamma \rightarrow \alpha$ transformation). In the thus obtained magnetic steel sheet, however, the density of aggregation of {100} planes parallel to the surface of the sheet is relatively low, 3 to 7 times that found in random orientation.

As described above, several structures and manufacturing methods are proposed for magnetic steel sheets wherein {100} planes parallel to the surface of the sheet densely. However, they still have various problems to be solved.

In order to solve the problems mentioned above, the present inventors proposed in Japanese Patent Application Laid-open (kokai) No. 1-108345 a method in which a cold-rolled silicon steel sheet containing C, Si, Mn and the like is annealed at two stages: open-coil annealing in a weak decarburizing atmosphere and open-coil annealing in a strong decarburizing atmosphere. The two-stage annealing provides a columnar grain texture composed of grains having the average grain diameter of 1 mm with {100} planes parallel to the surface of the sheet aggregated densely. By modifying conditions of rolling, various kinds of plane anisotropy, such as {100} <001> and {100} <021>, can be obtained.

A magnetic steel sheet subjected to the two-stage annealing exhibits a relatively large flux density at a magnetizing force of 1000 to 5000 A/m. However, it has a problem of increased core loss because its magnetic flux density is relatively small at a magnetizing force of not more than 100 A/m and increases sharply when a magnetizing force exceeds 100 A/m .

The present inventors evaluated an effect of the crystallographic texture (density of aggregation of {100} planes) on magnetic characteristics of a magnetic steel sheet in terms of a magnetic flux density ($B_{10}$, $B_{50}$) at a magnetizing force of 1000 to 5000 A/m. This revealed that at a magnetizing force of not more than 100 A/m , a flux density is mainly influenced by inclusions, distortions and the like and at 1000 to 5000 A/m by the crystallographic texture.

OBJECTS AND SUMMARY OF THE INVENTION

An object of the present invention is to provide a magnetic steel sheet having a high density aggregate of {100} planes parallel to the surface of the sheet, a relatively large magnetic flux density at a magnetizing force of not more than 100 A/m , relatively small core loss, and an excellent blanking performance.

The present inventors investigated the cause for: a magnetic flux density being relatively small at a magnetizing force of not more than 100 A/m and increasing sharply (also referred to as abnormal buildup of magnetization) at a magnetizing force of about 100 A/m , causing an increase in core loss. This investigation has revealed the following.

When a steel sheet undergoes open-coil annealing of a first stage in a weak decarburizing atmosphere, the surface of the sheet is decarburized and demanganized, thereby generating a layer lacking in manganese (hereinafter referred to as demanganized layer) extending from the surface of the sheet to a depth of about 50 μm. In the two-stage annealing method, this demanganized layer serves to densely develop {100} planes. The demanganized layer, however, remains even after the steel sheet undergoes open-coil annealing of a second stage in a strong decarburizing atmosphere, causing an abnormal buildup of magnetization at low magnetizing forces with a resultant degraded core loss characteristic.

The reason for an abnormal buildup of magnetization at low magnetizing forces with a resultant degraded core loss characteristic is not definite, but can be speculated to be as follows.

As the concentration of manganese increases, the bcc lattice of silicon iron swells slightly. Thus, if a large concentration gradient of manganese is present within a crystal grain, a portion of a lattice where the concentration gradient exists is distorted. Accordingly, when a large concentration gradient of manganese occurs in the vicinity of the surface of the sheet, the corresponding lattice distortion occurs. This lattice distortion hinders the movement of a domain wall which would otherwise move through magnetic distortion. As a result, an abnormal buildup of magnetization occurs at low magnetization forces, resulting in a degraded core loss characteristic.

To confirm the above speculation, the present inventors examined a magnetic steel sheet that was prepared as follows: a substance that accelerates decarburization (hereinafter referred to as a decarburization accelerator), or a combination of a decarburization accelerator and a substance (hereinafter referred to as a demanganization accelerator) that accelerates demanganization was placed as an annealing separator between layers of a coil of the magnetic steel sheet or between magnetic steel sheets, and then the thus prepared coil or layered body was annealed (refer to Japanese Patent Application Laid-open (kokai) No. 7-173542). The examination revealed that the thus prepared magnetic steel sheet has densely aggregated {100} planes parallel to the surface of the sheet, does not cause a sharp increase in a magnetic flux density with resultant small core loss, and exhibits an excellent blanking performance by: making lower than a predetermined level the ratio between the concentration of manganese in the surface portion of the sheet and that in the mid depth portion of the sheet, and determining an appropriate ratio of reduction in the concentration of manganese within the demanganized layer. In conjunction with the fact that as the crystal diameter increases, eddy current loss (a kind of core loss) increases and the fact that as the crystal diameter decreases, hysteresis loss (a kind of core loss) increases, the examination also revealed that the grain size having such an effect on core loss varies depending on the thickness of the sheet.

In addition to the above-described finding that sharp variations of a magnetic flux density can be prevented at low magnetizing forces by adopting an appropriate ratio of reduction in the concentration of manganese in the surface portion of,the sheet, the present inventors also found that core loss can be further reduced by applying a tension smaller than the elastic limit of the sheet to the sheet parallel to the surface of the sheet. This is achieved for the following reason: as a result of introducing a lattice distortion through demanganization to an extent so as not to cause a reduction in a magnetic flux density as well as a result of applying a tension to the magnetic steel sheet, domains within the sheet are further fragmented, resulting in reduced eddy current loss.

The present invention was achieved based on the above-described findings, and the gist thereof resides in the following magnetic steel sheets ①to ③.

① A magnetic steel sheet containing, on a weight basis, 0.2 to 6.5% of Si and 0.03 to 2.52 of Mn, having an crystallographic texture wherein the density of aggregation of {100} planes parallel to the surface of the sheet is not less than 10 times that of a non-oriented crystal grains, and having a demanganized layer in which the concentration of manganese decreases from the interior of the sheet toward the surface of the sheet, wherein the ratio between the concentration of manganese in the surface portion of the sheet and that in the mid depth portion of the sheet is not more than 0.90 and wherein the maximum ratio of reduction in the concentration of manganese within the demanganized layer is not more than 0.05 wt %/μm.

② A magnetic steel sheet containing, on a weight basis, 0.2 to 6.52 of Si and 0.03 to 2.52% of Mn, having an crystallographic texture wherein the density of aggregation of {100} planes parallel to the surface of the sheet is not less than 10 times that of a non-oriented crystal grains, and having a demanganized layer in which the concentration of manganese decreases from the interior of the sheet toward the surface of the sheet, wherein the ratio between the concentration of manganese in the surface portion of the sheet and that in the mid depth portion of the sheet is not more than 0.90, the maximum ratio of reduction in the concentration of manganese within the demanganized layer is not more than 0.05 wt %/μm, and wherein the average diameter of crystal grains is 0.25 to 10 times the thickness of the sheet.

③ A magnetic steel sheet containing, on a weight basis, 0.2 to 6.5% of Si and 0.03 to 2.5% of Mn, having excellent magnetic characteristics and blanking performance, having a crystallographic texture wherein the density of aggregation of {100} planes parallel to the surface of the sheet is not less than 10 times that of a non-oriented crystal grains, and having a demanganized layer in which the concentration of manganese decreases from the interior of the sheet toward the surface of the sheet, wherein the ratio between the concentration of manganese in the surface portion of the sheet and that in the mid depth portion of the sheet is not more than 0.90, the maximum ratio of reduction in the concentration of manganese within the demanganized layer is not more than 0.05 wt %/μm, and wherein a tension smaller than the elastic limit of the sheet is applied to the sheet parallel to the surface of the sheet.

BRIEF DESCRIPTION OF THE DRAWINGS

FIG. 3(*b*) is a graph showing the dependency of core loss on an angle from the direction of rolling;

FIG. 6(*b*) is a diagram schematically showing doubly oriented crystal grains.

DESCRIPTION OF PREFERRED EMBODIMENTS

Figure 1:
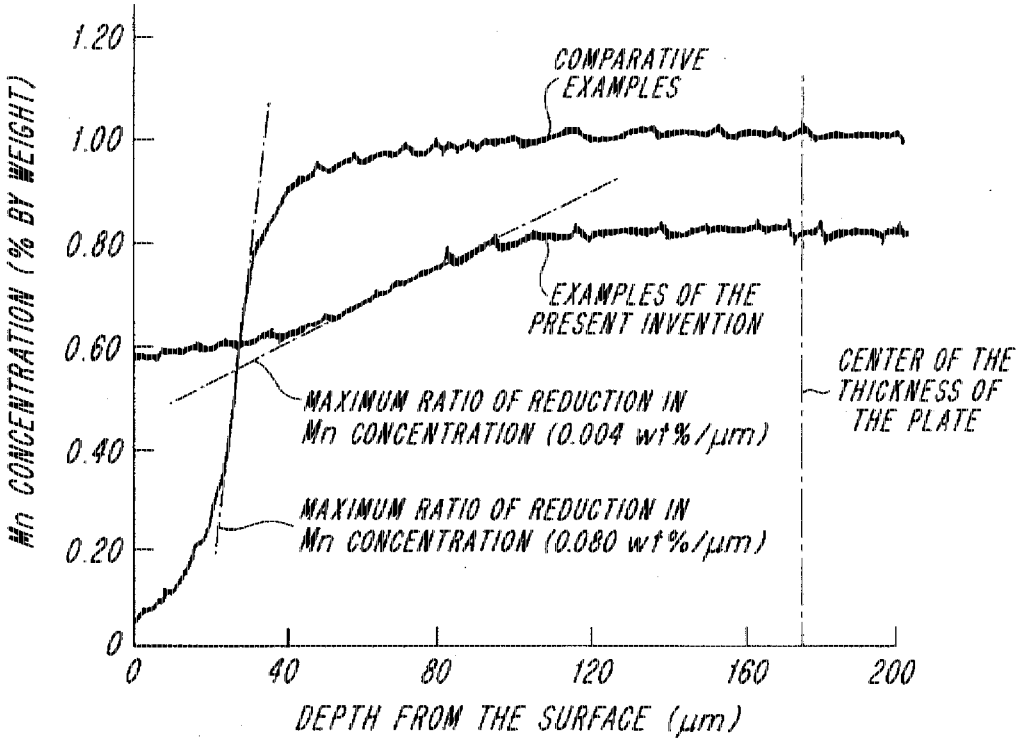
FIG. 1 is a graph showing distribution of Mn concentrations in the direction of thickness of a steel sheet which has undergone final annealing.

The present invention provides a magnetic steel sheet having densely aggregated {100} planes parallel to the surface of the sheet and having a demanganized surface layer with the ratio of reduction in the Mn concentration in the direction of thickness of the sheet being relatively small.

The reason why the chemical composition of the magnetic steel sheet is determined will next be described. Contents described below are average values with respect to the cross-section of the sheet, and % refers to wt %.

C: If carbon remaining in the steel sheet after final annealing is in excess of a solid limit in the a-ferrite phase, residual carbon will precipitate as cementite, which degrades magnetic characteristics (magnetic flux density and core loss). Accordingly, the smaller the C content after final annealing is, the better the result. In order to reduce the C content after final annealing, it is necessary for decarburization during annealing to increase an annealing temperature or to lengthen an annealing time. This, however, pushes up cost. As a result of balancing the manufacturing cost and the magnetic characteristics achieved, the allowable upper limit of the C content is determined to be 0.01%, preferably not more than 0.003%.

Since the crystallographic texture of {100 planes is controlled through decarburization and demanganization during final annealing, the C content before final annealing is preferably not less than 0.01%. However, a larger C content causes decarburization to take longer time. Thus, the upper limit of the C content before final annealing is determined to be 1.0%. The C content before final annealing is preferably not more than 0.5%, more preferably not more than 0.2%.

Si: In order to exhibit the effect of reducing eddy current loss by increasing electric resistance and to obtain good mechanical properties, the Si content is not less than 0.2, preferably not less than 1.0%. However, if the Si content is in excess of 6.5%, embrittlement of the steel sheet and a reduction in magnetic flux density will emerge. Thus, the upper limit of the Si content is determined to be 6.5%. The Si content is preferably not more than 5.0%, more preferably 4.0%.

Mn: Manganese contained in the steel sheet after final annealing exhibits effects of reducing eddy current loss by increasing electric resistance and improving blanking performance. If the Mn content is less than 0.03%, blanking performance will not be improved. Also, if the Mn content is in excess of 2.5%, a great reduction in a magnetic flux density will result. Accordingly, the Mn content in the steel sheet after final annealing is determined to be 0.03 to 2.5%.

Manganese contained in the steel sheet before final annealing possesses effects of controlling the crystallographic texture of {100} planes through decarburization and demanganization during final annealing and improving blanking performance by forming a demanganized layer. These effects, however, will not be provided if the Mn content is less than 0.05%. The Mn content in the steel sheet before final annealing, therefore, is determined to be not less than 0.05% , preferably not less than 0.1%, more preferably not less than 0.3%. In any case, it is preferable that Mn be contained in an amount not more than the maximum amount which causes a substantial α-ferrite phase at a temperature of not more than 850° C. after decarburization. This is from the reason that the presence of a large amount of Mn decreases the temperature at which the substantial α-ferrite phase is caused after completion of decarburization, and therefore, the annealing temperature must be set to low The word "substantial α-ferrite phase" refers to that trace amounts of secondary components (inclusions) such as MnS and AlN may exist. If Si is contained in larger amounts, Mn can also be contained in larger amounts. However, in order to prevent reduction in magnetic flux density, it is preferred that the upper limit of the Mn content before final annealing be 3.0%.

Examples of other elements which may be contained without impeding the effects of the present invention include the following:

Al: not more than 0.5%

W, V, Cr, Co, Ni, Mo: each being not more than 1%

Cu: not more than 0.5%

Nb: not more than 0.5%

N: not more than 0.05%.

S: not more than 0.5%

Sb, Se, As: each being not more than 0.05%.

B: not more than 0.005%

P: not more than 0.5%

The reason why the density ratio of {100} planes parallel to the surface of the sheet and the demanganized layer are determined will next be described.

1) Density ratio Q of {100} planes parallel to the surface of the sheet:

If the density ratio Q of {100} planes parallel to the surface of the sheet is less than 10, required magnetic characteristics (magnetic flux density and core loss) cannot be obtained. The larger the ratio is, the better the result. The ratio is preferably not less than 20.

2) Demanganized layer:

If a separator containing a demanganizing substance is used while the steel sheet is being annealed, a demanganized layer will be formed in which the concentration of manganese decreases from the interior of the sheet toward the surface of the sheet.

The demanganized layer accelerates the action of making {100} planes parallel to the surface of the sheet through $\gamma \rightarrow \alpha$ transformation during decarburization. Magnetic characteristics are improved by reducing the ratio of reduction in the Mn concentration, which reduces from the interior of the sheet toward the surface of the sheet. Also, blanking performance is improved by reducing a surface Mn concentration ratio, as described below. The "Mn concentration" refers to that measured using an electron probe micro analyzer (EPMA) or the like, and this Mn concentration is different from the Mn content in the steel sheet after final annealing. Distribution of Mn concentrations is measured by probing the surface of the steel sheet using EPMA while the steel sheet is undergoing chemical polishing to reduce its thickness, or via linear analysis using EPMA in the direction of thickness of the steel sheet.

The "surface Mn concentration ratio" is a value obtained by dividing the average of those Mn concentrations which are measured using EPMA over a span ranging from the surface of the sheet to a depth of 5 μm. by the Mn concentration in the mid depth portion of the sheet. If this ratio is in excess of 0.90, blanking performance of the sheet will degrade. Thus, the upper limit of the ratio is determined to be 0.90. The ratio is preferably 0.80. The smaller the lower limit of the ratio, the better the result. The lower limit, however, is preferably 0.05, so as to prevent the magnetic flux density from sharply increasing at a magnetizing force of about 100 A/m In the present specification, the expression "the surface of the steel sheet" refers to the surface after removing both a surface oxide layer and an insulating film which is applied after final annealing, i.e. the surface or the outermost layer surface of a portion in the substantial α-ferrite phase.

The "ratio of reduction in the Mn concentration in the demanganized layer in the direction of thickness of the sheet" refers to a value obtained by differentiating Mn concentration with respect to the depth when distribution of Mn concentrations in the direction of thickness of the sheet measured using EPMA or the like is represented as a function of depth from the surface. The "maximum ratio of reduction in the Mn concentration" refers to a maximum differential value obtained. When the differentiation is carried out, local variations caused by precipitate or the like within an α-ferrite crystal grain of steel are eliminated.

If the maximum ratio of reduction in the Mn concentration in the direction of thickness of the sheet is in excess of 0.05%/μm, a sharp increase in magnetic flux density will occur at low magnetizing forces, resulting in a degraded core loss characteristic. Therefore, the maximum limit of the ratio is determined to be 0.05%/μm. The ratio is preferably 0.03%/μm, more preferably 0.01%/μm. In order to obtain good blanking performance, the lower limit of the ratio is preferably 0.0001%/μm.

3) Thickness of steel sheet:

If the steel sheet is thicker, decarburization in final annealing will take longer times, and also eddy current loss will increase. The steel sheet thickness is preferably not more than 1.0 mm, more preferably not more than 0.5

4) Crystal diameter:

As the grain diameter increases, eddy current loss (a kind of core loss) increases. As the grain diameter decreases, hysteresis loss (a kind of core loss) increases. The grain size having such an effect on core loss varies depending on the thickness of the sheet. When the grain diameter is less than 0.25 times the thickness of the sheet, hysteresis loss becomes excessive. When the grain diameter is in excess of 10 times the thickness of the sheet, eddy current loss becomes excessive. Accordingly, the grain diameter is determined to be 0.25 to 10 times the thickness of the sheet, preferably 0.5 to 7 times. Even when a steel sheet does not meet this requirement for the crystal grain diameter, it provides excellent magnetic characteristics and blanking performance if it meets requirements described above in ① under OBJECTS AND SUMMARY OF THE INVENTION. In a steel sheet wherein the ratio of reduction in the Mn concentration in the direction of thickness of the sheet is controlled to not more than 0.05%/μm, when the crystal grain diameter is adjusted to 0.25 to 10 times the thickness of the sheet, eddy current loss balances best with hysteresis loss, resulting in low core loss.

The crystal grain diameter is represented by the average of grain diameters, which are obtained as follows. A straight line is drawn on a cross-section of the sheet taken parallel to the surface of the sheet. Then, the number of grain boundaries which cross the straight line is counted. The length of the straight line is divided by the number of grain boundaries obtained.

5) Tension applied within the sheet:

In order to further reduce core loss, a tension smiler than the elastic limit of the sheet is applied within the sheet in a direction parallel to the surface of the sheet. A tension to be applied must be smaller than the elastic limit of the sheet because if the tension is too large, the sheet will suffer a plastic deformation, resulting in degraded magnetic characteristics. The tension is preferably not more than 5 kg/mm$^2$, more preferably not more than 3 kg/mm$^2$. The lower limit of the tension is not particularly determined, but to obtain a significant effect of the tension, it is preferably 0.1 kg/mm$^2$, more preferably 0.2 kg/mm$^2$. Preferably, the tension is applied omnidirectionally for a non-oriented steel sheet, and in either of two directions providing excellent magnetic characteristics for a doubly oriented steel sheet.

The method of applying the tension is not particularly limited. The tension may be mechanically applied when steel sheets are assembled into a core, or may be applied through an insulating film which is formed in a process of manufacturing a steel sheet. For example, the tension is applied through an insulating film in the following manner: after an inorganic material for a high-strength insulating film is applied to the surface of the steel sheet, the coated steel sheet is baked at a temperature of 400° to 800° C. and then cooled, which causes the tension to be applied omnidirectionally because of a difference in contraction between the insulating film and the steel sheet. Alternatively, after an inorganic material for the insulating film is applied, a tension is mechanically applied to the steel sheet in one direction while the sheet is baked at a temperature of 400° to 800° C. Then, after the steel sheet is cooled, the tension mechanically applied is removed to apply a unidirectional tension to the steel sheet by utilizing a difference in elastic deformation between the insulating film and the steel sheet.

In the magnetic steel sheet according to the present invention, its surface is not oxidized in final annealing (described below), and many depressions and protrusions having a size of not more than 1 μm are formed on its surface while a crystallographic texture develops due to final annealing. Thus, a strong bond is established between an insulating film and the steel sheet, so that the insulating film does not separate from the surface of the sheet even when a tension is applied within the sheet.

A method of manufacturing the magnetic steel sheet will be described.

6) Final annealing:

The above described magnetic characteristics (magnetic flux density and core loss) are obtained by the following practice: a decarburization accelerator or the mixture of a decarburization accelerator and a demanganization accelerator is placed as an annealing separator between layers of a coil of the cold-rolled steel sheet or between cold-relied steel sheets, and then the thus prepared coil or layered body is annealed. As a result of the annealing, the steel sheet is decarburized as a whole, and also the surface portion of the sheet is both decarburized and demanganized. In the process of decarburizing and demanganizing the surface portion, $\gamma \rightarrow \alpha$ transformation occurs, which causes {100} planes parallel to the surface of the sheet to densely aggregate. Conditions of the annealing are established such that the $\gamma \rightarrow \alpha$ transformation advances from the surface of the sheet toward the interior of the sheet. The surface energy of a crystal grain with its {100} plane being parallel to the surface of the sheet is lower than that of a crystal grain with its {100} plane being not parallel to the surface of the sheet. Accordingly, crystal grains having their {100} plane parallel to the surface of the sheet dominantly grow from the surface of the sheet toward the interior of the sheet, whereby a crystallographic texture having densely aggregated {100} planes parallel to the surface of the sheet is obtained.

Examples of the decarburization accelerator include $SiO_2$, an oxide of silicon. Decarburization accelerate by $SiO_2$, which is used as an annealing separator, is speculated to follow the following mechanism.

The silicon oxide becomes unstable when the temperature goes up to approximately 1000° C. to cause the following decomposition which generates oxygen.

$$SiO_2 \rightarrow SiO + O \quad (1)$$

The oxygen generated by this reaction reacts with C in steel sheet as shown by scheme (2) below, producing carbon monoxide gas to achieve decarburization.

$$O + C \text{ (in steel sheet)} \rightarrow CO \text{ (gas)} \quad (2)$$

There are other substances that exhibit the above function, which include $Cr_2O_3$, FeO, $V_2O_3$, $V_2O_5$, VO, and MnO. They are relatively unstable oxides at a high temperature in a certain proper atmosphere. In other words, they are compounds which decompose at an annealing temperature to generate oxygen which accelerates decarburization.

It is possible to use one species or a mixture of two or more species together with inorganic materials which are stable at a high temperature, including stable oxides such as $Al_2O_3$, and stable nitrides and carbides such as BN and SiC. However, using of quite unstable oxides such as the alkaline earth group and carbonates of alkali metal (e.g. $CaCO_3$ and $Na_2CO_3$) must be avoided. These oxides cause a large amount of oxide to be generated, which oxidizes Si and Mn contained in steel sheet, causing the state of energy of the surface of the steel sheet to alter with a resultant reduction in the density of aggregation of {100} planes parallel to the surface of the sheet.

Even when any of these accelerators is only used for annealing, demanganization occurs to some extent. However, the combined use with another demanganization accelerator allows the demanganized layer to further grow. Examples of the demanganization accelerator includes $TiO_2$, an oxide of titanium.

Mn in a steel sheet sublimes from the surface of the sheet in an appropriate annealing atmosphere, which causes a layer lack of Mn (demanganized layer) to be formed in the vicinity of the surface of the sheet. $TiO_2$ is speculated to react with Mn subliming from the steel sheet to form $TiMnO_2$, a compound oxide. In this manner, subliming Mn is absorbed to accelerate demanganization. Any substances which absorb Mn subliming from a steel sheet during annealing can be used as a demanganization accelerator unless they affect decarburization and the state of surface energy of the steel sheet. Examples of another demanganization accelerator include $ZrO_2$ and $Ti_2O_3$.

The form of the annealing separator containing substances which accelerate decarburization and demanganization is not particularly limited. It my take the form of plates, powders, fibrous materials, sheets made of fibers, or sheets containing powders. Most preferably, the separator is a fibrous material or a sheet composed of fibers. This is because fibrous materials or sheets composed of fibers do not fall from the interlayers of the coil. In addition, voids present among the fibers function to easily discharge carbon monoxide generated by the aforementioned reaction, and surface $\gamma \rightarrow \alpha$ a transformation is accelerated due to the sublimation of Mn in the voids, The fibrous material or sheet may be inserted in between layers of the coil or between the steel sheets to be annealed.

Annealing is preferably performed in an atmosphere in which a hydrogen gas, an inert gas, or a mixture gas of both is the major component, or in vacuum. Preferably, the atmosphere is a vacuum of 100 Torr or less. More preferably, the atmosphere is a vacuum of 1 Torr or less. If the pressure of the atmosphere is in excess of 100 Torr, desired oxygen removing reaction and decarburization reaction cannot be achieved, and in addition, a crystallographic texture having highly aggregated {100} planes parallel to the surface of the sheet cannot be obtained.

In order to obtain a crystallographic texture having highly aggregated {100} planes parallel to the surface of the sheet, it is necessary to maintain a temperature range over 850° C. which permits co-existence of alpha ($\alpha$)+gamma ($\gamma$) two phases or a temperature range of a gamma ($\gamma$) single phase. However, an annealing temperature in excess of 1300° C. is industrially infeasible. The annealing temperature, therefore, is preferably 850° to 1300° C.

Soaking for less than 30 minutes results in an insufficient decarburization or demanganization. On the other hand, soaking for over 100 hours will reduce the productivity. Accordingly, the soaking period for annealing is preferably from 30 minutes to 100 hours.

7) Cold-Rolling of a Steel Sheet

Figure 6A:
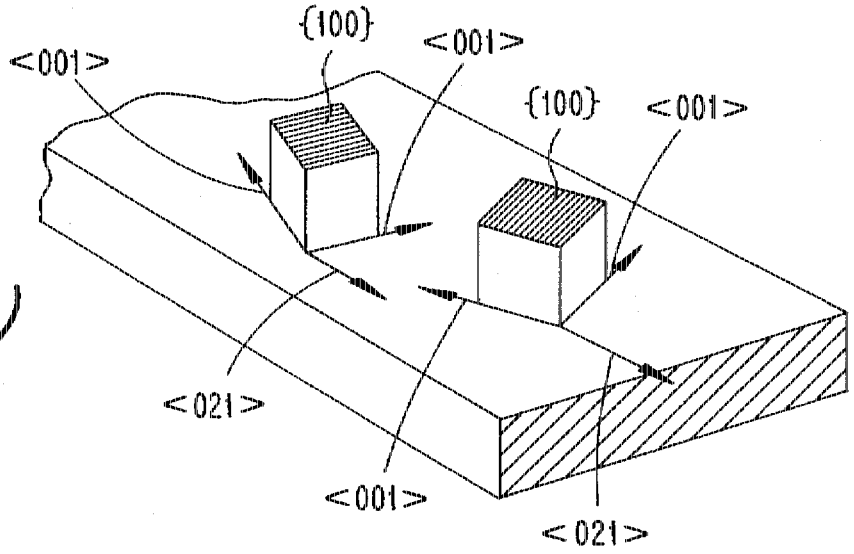
FIG. 6(*a*) is a diagram schematically showing non-oriented crystal grains.
Figure 6B:
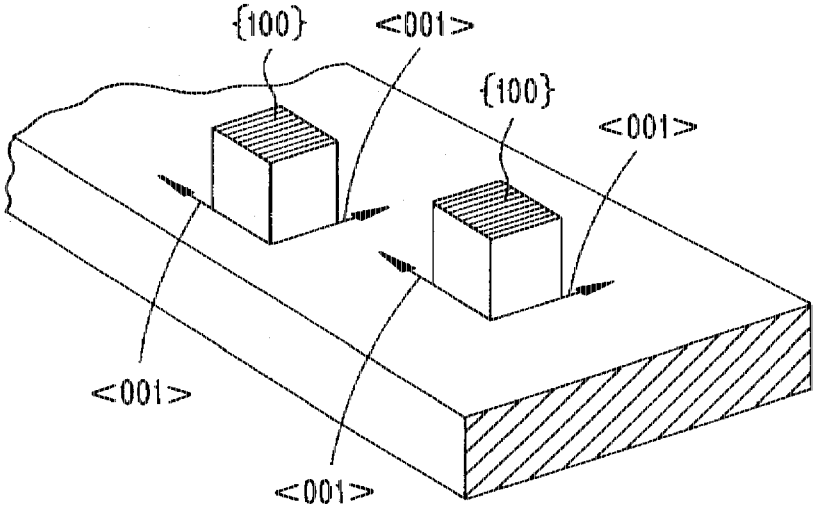

By controlling conditions of cold-rolling, the following two kinds of steel sheets can be obtained: a steel sheet (shown in FIG. 6(*a*)) having a near {100} <021> crystallographic texture which omnidirectionally exhibits substantially the same magnetic characteristics within a plane of rolling; and a steel sheet (shown in FIG. 6(*b*)) having the {100} <001> crystallographic texture which exhibits excellent magnetic characteristics in two directions, namely the direction of rolling and the width direction of the sheet.

Cold-rolling causes distribution of <001> axes parallel to the surface of the sheet to change, thereby varying dependence of magnetic characteristics (magnetic flux density and core loss) on a direction within the surface of the sheet.

As stated earlier, it is preferred that a magnetic steel sheet to be used as a material for a core of a rotating machine should not have dependency of magnetic characteristics (magnetic flux density and core loss) on a direction within the surface of the sheet (this feature is hereinafter referred to as "non-oriented").

Figure 3A:
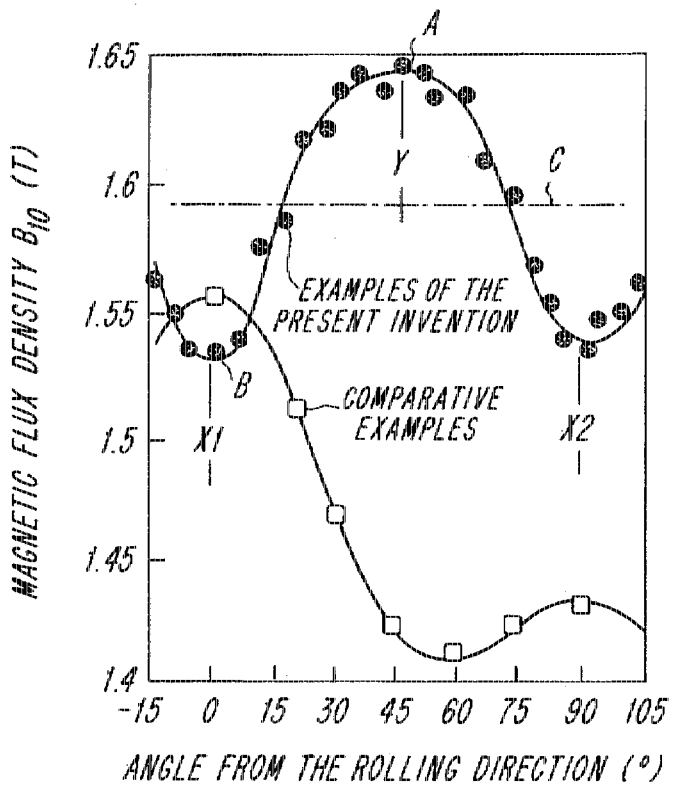
FIG. 3(*a*) is a graph showing the dependency of a magnetic flux density on an angle from the direction of rolling.
Figure 3B:
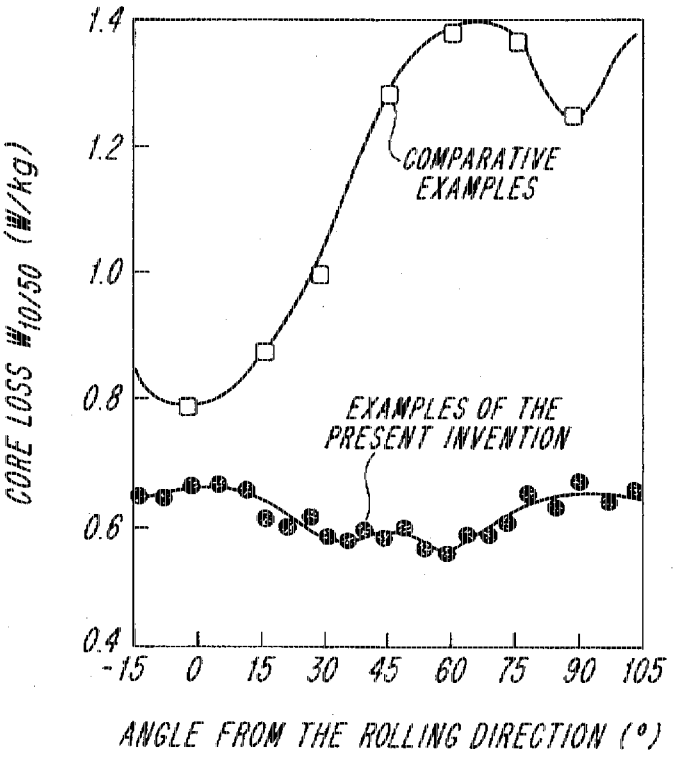

FIGS. 3(*a*) and 3(*b*) show dependence of magnetic characteristics of Examples (described later) on an angle from the direction of rolling. Specifically, FIG. 3(*a*) shows dependence of magnetic flux density on the angle, and FIG. 3(*b*) shows dependence of core loss on the angle. Magnetic flux density and core loss are closely related to each other. If crystallographic textures are controlled so as to increase magnetic flux density, core loss will reduce. Accordingly, the expression "dependency of magnetic characteristics (magnetic flux density and core loss) on a direction within the surface of the sheet is small" means that value (A−B)/C (see FIG. 3(*a*)) is small where: A and B are maximum and minimum values, respectively, of magnetic flux densities B10 measured omnidirectionally within the sheet plane; (A−B) is a maximum deviation between maximum value A and minimum value B; and C is the average value of magnetic flux densities $B_{10}$ measured. In the present invention, non-orientation refers to that value (A−B)/C of not more than 0.15. The value is preferably not more than 0.12, more preferably 0.10.

A steel sheet having a value (A−B)/C of not more than 0.15 is obtained by the following method: a hot-rolled steel sheet is cold-rolled (a hot-rolled steel sheet is cold-rolled at a reduction ratio of not less than 50% without being subjected to intermediate annealing) once, followed by final annealing using a decarburization accelerator or both a decarburization accelerator and a demanganization accelerator.

Figure 4:
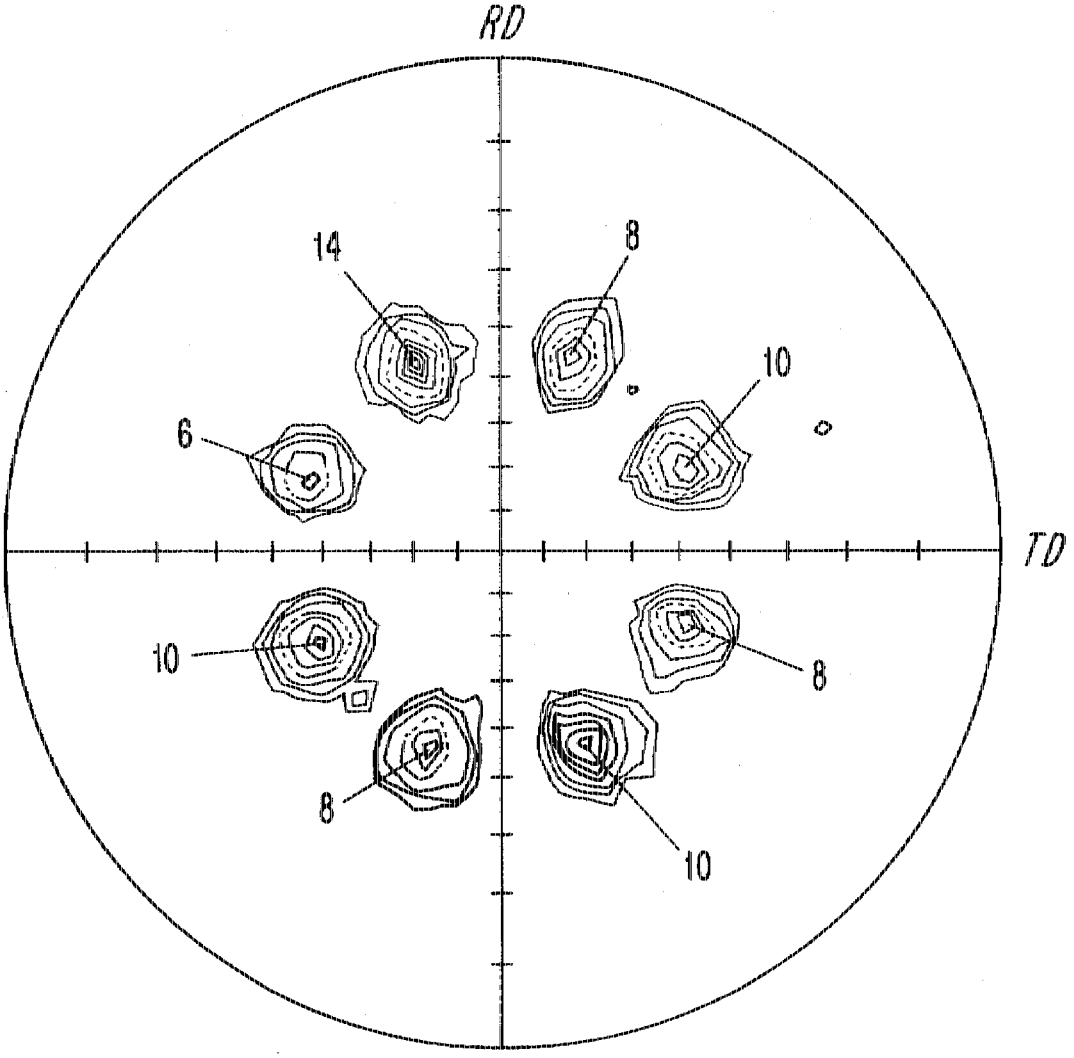
FIG. 4 is a {110} pole chart of a steel sheet which has undergone final annealing.

FIG. 4 is a {110} pole chart of a steel sheet according to an Embodiment (described later) which has undergone final annealing. In FIG. 4, RD denotes the direction of rolling, and TD denotes the width direction of the sheet. In a steel sheet which has undergone the aforementioned processes, the {100} <021> crystallographic texture shown in FIG. 6(*a*) is developed, and the <001> axes of easy magnetization aggregate in eight directions within the surface of the sheet as shown in FIG. 4. A reduction ratio of cold-rolling is not less than 50% , preferably not less than 70%.

Preferably, in a doubly oriented steel sheet, magnetic characteristics (magnetic flux density and core loss) are improved in the following two directions: the direction of rolling and the width direction of the sheet. This steel sheet is obtained by the following method: a steel sheet is cold-rolled a plurality of times and subjected to intermediate annealing performed between cold-rollings, followed by final annealing using a decarburization accelerator or both decarburization accelerator and demanganization accelerator. A cumulative reduction ratio of cold-rolling is not less than 50%, preferably not less than 70%. In addition, a reduction ratio of first cold-rolling is preferably 30 to 90%. The intermediate annealing temperature is 700° to 1100° C., which is higher than a temperature at which recrystallization occurs. A ratio of temperature rise and the soaking period for annealing are not particularly limited. Also, the type of an annealing furnace is not particularly limited. In actuality, however, in order to improve annealing efficiency, it is preferred that a continuous annealing furnace be used, the temperature be raised at a ratio of not less than 100° C./min, and the soaking time for annealing be not more than 30 minutes.

The expression "magnetic characteristics are particularly improved in the direction of rolling and the width direction of the sheet" means that magnetic flux density in the direction of rolling and the width direction of the sheet is greater than that in a direction within the surface of the sheet which is 45° away from the direction of rolling. In other words, the expression means that ratio 2(X−Y)/(X+Y) obtained by dividing (X−Y) (difference between X and Y) by (X+Y)/2(average of X and Y) is not less than 0.16 where: X is the average of X1 and X2((X1+X2)/2), X1 is magnetic flux density $B_{10}$ in the direction of rolling, X2 is magnetic flux density $B_{10}$ in the width direction of the sheet, and Y is magnetic flux density $B_{10}$ in a direction which is 45° away from the direction of rolling (see FIG. B(*a*) illustrating magnetic profiles of steel sheets magnetized at a magnetizing force of 1000 A/m). The ratio is preferably not less than 0.20, more preferably not less than 0.25.

8) Surface film:

A surface film serves as a lubricant when core blanks are blanked out from a magnetic steel sheet, and also as an electric insulator when core blanks are united into a layered body to form a core. Surface films are classified into two types, inorganic and inorganic-organic. An inorganic surface film is formed by applying a phosphate or chromate solution to the surface of a steel sheet and then subjecting the applied film to baking. An organic-inorganic film is formed by applying a mixture of the aforementioned inorganic solution and an organic resin such as polyacrylic emulsion to the sheet surface and then subjecting the applied film to baking. In order to improve blanking performance of a steel sheet, the organic-inorganic film is preferable.

9) Flattening:

A steel sheet which has undergone final annealing exhibits a poorer flatness than that before annealing. In order to improve flatness after final annealing, skin pass rolling, continuous annealing, or both skin pass rolling and continuous annealing may be carried out in some cases. Skin pass rolling is performed cold at a reduction ratio of not more than 10%, at which crystallographic textures will not be destroyed, after an annealing separator is removed and before a surface film is applied. Continuous annealing is preferably performed when or after an applied surface film is baked

EXAMPLES

Example 1

Molten steels A to H having chemical compositions shown in Table 1 were melted by a vacuum casting process into ingots each measuring 150 mm (thickness)×200 mm (width)×350 mm (length). These ingots were hot-forged to prepare steel plates each having a thickness of 80 mm, after which each steel plate was hot-rolled to prepare a steel sheet having a thickness of 4 mm, and then cold-rolled to a thickness of 0.35 mm. From the resultant cold-rolled steel sheets, test sheets each having a size of 250 mm (width)×600 mm (length) were obtained, and these test sheets were subjected to final annealing described below. A chemical composition shown in Table 1 gives average values obtained by chemical analysis.

For comparison, comparative examples were subjected to first-stage open-coil annealing at a temperature of 950° C. for 8 hours in a vacuum of $10^{-5}$ Torr, followed by second-stage strong-decarburization open-coil annealing at a temperature of 850° C. for 3 hours in a hydrogen atmosphere whose dew point is 30° C.

TABLE 1

| | Composition (% by weight, remainder: Fe and impurities) | | | | | | | | |
|---|---|---|---|---|---|---|---|---|---|
| Steel | C | Si | Mn | Al | P | S | N | Ni | Cr |
| A | 0.020 | 1.00 | 0.20 | <0.001 | <0.001 | 0.001 | 0.005 | 0.1 | <0.01 |
| B | 0.030 | 1.81 | 0.51 | 0.02 | 0.01 | 0.004 | 0.010 | <0.01 | 0.2 |
| C | 0.092 | 2.67 | 0.81 | <0.001 | <0.001 | 0.001 | 0.003 | <0.01 | <0.01 |
| D | 0.068 | 3.02 | 1.02 | <0.001 | <0.001 | 0.003 | 0.002 | <0.01 | <0.01 |
| E | 0.034 | 2.83 | 1.81 | <0.001 | <0.001 | 0.007 | 0.008 | <0.01 | <0.01 |
| F | 0.150 | 4.30 | 0.76 | <0.001 | <0.001 | 0.010 | 0.001 | <0.01 | <0.01 |
| G | 0.001 | 3.50 | 0.30 | 0.1 | <0.001 | 0.001 | 0.003 | <0.01 | <0.01 |
| H | 0.052 | 2.92 | 1.12 | 0.003 | 0.002 | 0.002 | 0.004 | <0.01 | <0.01 |

Fibrous decarburization accelerators containing 48 wt % $Al_2O_3$51 wt % $SiO_2$ and demanganization powder accelerator containing $TiO_2$ were placed, as separators, between layers of the test sheets to achieve a density of 0.02 g/cm$^2$ for the decarburization accelerators and a density of 0.004 g/cm$^2$ for the demanganization powder accelerator. The thus prepared layered body was subjected to final annealing under a surface pressure of 0.1 kg/cm$^2$ in a vacuum of $10^{-3}$ Torr. In the final annealing, steels A and B were soaked at a temperature of 950° C. for 50 hours, whereas steels C through F were soaked at a temperature of 1050° C. for 12 hours.

The test sheets which had undergone final annealing were analyzed to obtain chemical composition, density ratio Q of {100} planes parallel to the surface of the sheet, surface Mn concentration ratio, ratio of reduction in Mn concentration in the direction of thickness of the sheet, and magnetic characteristics.

The density ratio of {100} planes parallel to the surface of the sheet was obtained as the ratio of the density of aggregation of {100} planes parallel to the surface of the sheet, which was obtained by SEM and gPC for each test sheet, to that of a test piece with no orientation. Results of the above analysis are shown in Table 2.

TABLE 2

| | | | Composition | | | Mn concentration | | | Density ratio of (100) planes parallel to the surface of sheet | Properties after annealing | | | |
|---|---|---|---|---|---|---|---|---|---|---|---|---|---|
| | No. | Steels used | C ppm | Si % | Mn % | Mn concentration in the surface % | No concentration in the surface | Maximum ratio of reduction %/μm | | Presence or absence of abnormal magnetization | Magnetic flux density $B_1$, T | Magnetic flux density $B_{10}$, T | Core loss $W_{15/50}$ W/kg |
| Examples of the present invention | 1 | A | <25 | 1.00 | 0.05 | 0.02 | 0.30 | 0.0015 | 28 | absence | 1.15 | 1.64 | 3.25 |
| | 2 | B | " | 1.80 | 0.34 | 0.18 | 0.35 | 0.0020 | 35 | absence | 1.30 | 1.63 | 2.30 |
| | 3 | C | " | 2.66 | 0.51 | 0.30 | 0.45 | 0.0055 | 52 | absence | 1.40 | 1.60 | 1.65 |
| | 4 | D | " | 3.02 | 0.71 | 0.57 | 0.71 | 0.0040 | 65 | absence | 1.38 | 1.59 | 1.55 |
| | 5 | E | " | 2.82 | 1.40 | 0.96 | 0.64 | 0.0100 | 58 | absence | 1.35 | 1.58 | 1.52 |
| | 6 | F | " | 4.31 | 0.51 | 0.40 | 0.73 | 0.0035 | 45 | absence | 1.30 | 1.56 | 1.32 |
| Comparative examples | 7 | A | <25 | 0.99 | 0.15 | 0.008 | 0.05 | 0.052 | 22 | presence | 0.92 | 1.63 | 3.82 |
| | 8 | B | " | 1.82 | 0.42 | 0.06 | 0.12 | 0.058 | 26 | presence | 1.05 | 1.61 | 2.89 |
| | 9 | C | " | 2.65 | 0.72 | 0.13 | 0.16 | 0.060 | 35 | presence | 1.10 | 1.57 | 1.87 |
| | 10 | D | " | 3.01 | 0.91 | 0.08 | 0.08 | 0.080 | 46 | presence | 1.12 | 1.59 | 1.75 |
| | 11 | E | " | 2.80 | 1.62 | 0.83 | 0.18 | 0.097 | 30 | presence | 1.13 | 1.56 | 1.76 |
| | 12 | F | " | 4.28 | 0.64 | 0.05 | 0.07 | 0.067 | 38 | presence | 1.03 | 1.55 | 1.58 |

Primary components of the decarburization accelerator employed: 48% by weight $Al_2O_3$ – 51% by weight $SiO_2$.
Primary components of the demanganese accelerator employed: $TiO_2$ The Mn concentration and the ratio of reduction in Mn concentration in the direction of thickness of the sheet were obtained by conducting a linear analysis using EPMA in the direction of the thickness of the sheet.

FIG. 1 is a graph showing distribution of Mn concentrations in the direction of the thickness of the sheet which are obtained by linear analysis using EPMA. In FIG. 1, the curve designated as Invention Example represents measurements of Invention Example No. 4 in Table 2, and the curve designated as Comparative Example represents measurements of Comparative Example No. 10 in Table 2. These Mn concentrations which were obtained using EPMA are corrected based on standard samples having known chemical analytic values.

In Invention Example No. 4, the Mn concentration in the central portion is 0.80 wt %, the surface Mn concentration is 0.57 wt %, and the surface Mn concentration ratio is 0.71. In Comparative Example No. 10, the surface Mn concentration ratio is 0.10. The ratio of reduction in the Mn concentration in the direction of thickness of the sheet was obtained by differentiating the Mn concentration in the direction of thickness of the sheet with respect to the thickness of the sheet. As seen from Table 2, a maximum value of the ratio obtained by the differentiation is 0.004 wt %/μm for Invention Example No. 4 and 0.08 wt %/μm for Comparative Example No. 10. Table 2 shows these characteristic values obtained in the manner described above for each test sheet.

Each test sheet was blanked to obtain 20 rings of test pieces each having an inner diameter of 33 mm and an outer diameter of 45 m. The rings were held in a nitrogen gas atmosphere at 800° C. for 1 hour to remove strain caused by blanking. The rings were united into a layered body, on which 100 turns each of a primary coil and a secondary coil were wound to measure magnetic characteristics in a magnetic field with 50 Hz sinusoidal alternating magnetic flux density.

Figure 2:
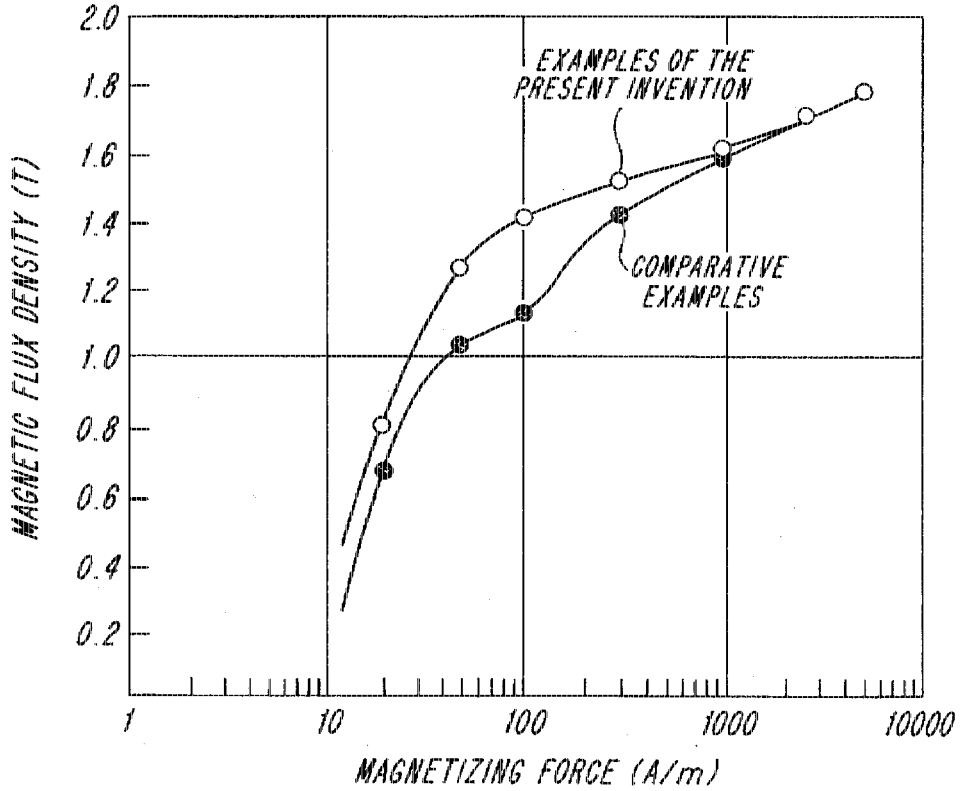
FIG. 2 is a graph showing the magnetizing profile of a steel sheet which has undergone final annealing.

FIG. 2 shows magnetization curves prepared from measurements obtained as above. In FIG. 2, the curve designated as Invention Example represents measurements of Invention Example No. 4 in Table 2, and the curve designated as Comparative Example represents measurements of Comparative Example No. 10 in Table 2. In Invention Example No. 4, a maximum ratio of reduction in the Mn concentration in the direction of thickness of the sheet is 0.004 wt % /μm, whereas in Comparative Example No. 10, the maximum ratio is 0.08 wt % . As seen from FIG. 2, the Invention Example shows a relatively large magnetic flux density even at low magnetizing forces and does not show any sharp rise of a magnetic flux density. By contrast, the Comparative Example show a relatively small magnetic flux density at a magnetizing force of up to 100 A/m and a sharp increase in magnetic flux density at a magnetizing force of near 100 A/m, indicating that an abnormal magnetization occurs at low magnetizing forces. Whether or not this abnormal magnetization is present is shown in Table 2 for each test sheet. Table 2 also shows magnetic flux densities $B_1$ and $B_{10}$ measured while an external magnetic field of 100 A/m and 1000 A/m, respectively, was applied to the primary coil, and core loss $W_{15/50}$ measured when the test pieces were magnetized to a magnetic flux density of 1.5 T (Tesla) in an alternating magnetic field of 50 Hz. The following is seen from Table 2.

Invention Examples Nos. 1 to 6 show a density ratio of {100} planes parallel to the surface of the sheet ranging from 28 to 65, which is equivalent to or slightly larger than that of Comparative Examples Nos. 7 to 12 which have undergone two-stage annealing. The Invention Examples show a ratio of reduction in the Mn concentration of not more than 0.010 wt %/μm, indicating that a sharp increase in a magnetic flux density does not occur at low magnetizing forces. Thus, $B_1$ (magnetic flux density) of each of the Invention Examples is 0.2 to 0.8 T greater than that of the corresponding Comparative Example of the same steel type. This higher magnetic flux density exhibited at a low magnetizing force causes core loss to reduce 0.2–0.6 W/kg from the level of the corresponding Comparative Example. By contrast, the Comparative Examples show a ratio of reduction in the Mn concentration of not less than 0.052 wt %/μm, resulting in a sharp rise of magnetic flux density at a low magnetizing force.

A blanking test was conducted using a coiled material. Each of two ingots of steel D shown in Table 1 was hot-forged to prepare a steel plate having a thickness of 60 mm, after which the steel plate was hot rolled to prepare a steel sheet having a thickness of 3.5 mm. One of the thus prepared steel sheets was acid cleaned and then cold rolled to a thickness of 0.35 mm obtaining a coil having a width of 300 mm. The thus obtained coil was subjected in the state of tight coil to final annealing using a decarburization accelerator and a demanganization accelerator. Subsequently, the annealed coil was unwound, and an annealing separator was removed therefrom. Then, a mixture of a chromate solution and a polyacrylic emulsion resin was applied to the coil to form an organic-inorganic insulating film having a thickness of about 3 μm. followed by baking. For comparison, a steel sheet having no demanganized layer was prepared as described below from another hot-rolled steel sheet having a thickness of 3.5 mm. The hot-rolled steel sheet was decarburized at a temperature of 800° C. for 10 hours in a hydrogen atmosphere containing water vapor, acid cleaned, and then cold rolled to a thickness of 0.35 mm. The thus obtained steel sheet was subjected to final annealing at a temperature of 900° C. for 1 minute in a nitrogen atmosphere, and then coated with an organic-inoganic insulating film in a manner similar to that described above.

These two steel sheets were subjected to a blanking test to obtain a blanking count before the height of burrs becomes 50 μm due to wear of a tool.

Test conditions are as follows: blanks have a circular shape having a diameter of 20 mm; the clearance between a die and a punch is 6%; the tool material is JIS SKD-1, an alloy tool steel.

The test revealed that the invention steel sheet (having a demanganized layer) having a surface Mn concentration ratio of 60% allowed 800,000 times of blanking. By contrast, the comparative steel sheet (not having a demanganized layer) having a surface Mn concentration ratio of 99% allowed 160,000 times of blanking.

Example 2

A steel C ingot shown in Table 1 was hot-forged to prepare steel plates each having a thickness of 60 mm, after which each steel plate was hot-rolled to prepare a steel sheet having a thickness of 3.5 mm. Subsequently, each steel sheet was acid cleaned and then cold-rolled to a thickness of 0.35 mm. The resultant steel sheets had a width of 300 mm. From the resultant cold-rolled steel sheets, test sheets each having a size of 250 mm (width)×600 mm (length) were obtained, and these test sheets were subjected to final annealing described below.

Fibrous decarburization accelerators containing 48 wt % $Al_2O_3$–51 wt % $SiO_2$ were placed, as separators, between layers of the test sheets to achieve a density of 0.05 g/cm$^2$. The thus prepared layered body was subjected to final annealing under a surface pressure of 0.1 kg/cm$^2$ in a vacuum of $10^{-3}$ Torr. In the final annealing, the temperature was raised to 1050° C. at a ratio of 2° C./min, and then individual layered bodies were soaked at the temperature for different periods of time ranging from 2 hours to 100 hours.

A comparative example was prepared as follows. A steel G ingot shown in Table 1 was hot-forged to prepare a steel plate having a thickness of 60 mm after which the steel plate was hot-rolled to prepare a steel sheet having a thickness of 3 mm. Subsequently, the steel sheet was acid cleaned and then subjected to annealing at 800° C. for 3 hours in an $N_2$ gas atmosphere. The annealed steel sheet was cold-rolled to a thickness of 0.35 mm and then subjected to annealing at 975° C. for 3 hours in an $N_2$ gas atmosphere. The thus prepared steel sheet has substantially equivalent texture crystallographic texture and crystal grain diameter) and magnetic characteristics (magnetic flux density and core loss) to those of a commercial high grade non-oriented magnetic steel sheet (S-9).

The test sheets which had undergone final annealing were analyzed to obtain chemical composition, average grain diameter, density ratio of {100} planes parallel to the surface of the sheet. Mn concentration, and core loss. Their measurements are shown in Table 3. The average grain diameter is obtained as follows. A straight line is drawn on a cross-section of the sheet taken parallel to the surface of the sheet. Then, the number of grain boundaries which cross the straight line is counted. The length of the straight line is divided by the number of grain boundaries obtained. Core loss $W_{15/50}$ shown in Table 3 is, as in Table 1, the one which is measured when magnetization is performed to a magnetic flux density of up to 1.5 T in a magnetic field alternating at 50 Hz.

As seen from Table 3, Invention Example Nos. 13 to 24 show a core loss $W_{15/50}$ of 1.48 to 1.86 W/kg, which is lower than a core loss of 2.36 W/kg of Comparative Example No. 25. Further, when a ratio of the average grain diameter to the thickness of the sheet falls in a range of 0.51 to 7.81, which corresponds to Invention Examples Nos. 15 to 22, the core loss $W_{15/50}$ falls in a lower range of 1.48 to 1.59 W/kg.

TABLE 3

| | | | Soaking period of final | Composition | | | Mn concentration | | Density ratio of (100) planes parallel to the surface | average grain | | Properties after annealing | |
|---|---|---|---|---|---|---|---|---|---|---|---|---|---|
| | No. | Steels used | annealing hr | C ppm | Si % | Mn % | Mn Concentration in the surface | Maximum ratio of reduction %/μm | of sheet | diameter | ratio to sheet thickness | Presence or absence of abnormal magnetization | Core loss $W_{15}/_{50}$, W/kg |
| Examples of the present invention | 13 | C | 2 | <25 | 2.66 | 0.74 | 0.25 | 0.021 | 28 | 0.074 | 0.21 | absence | 1.86 |
| | 14 | " | 4 | " | 2.65 | 0.71 | 0.28 | 0.915 | 35 | 0.084 | 0.24 | absence | 1.75 |
| | 15 | " | 6 | " | 2.67 | 0.68 | 0.32 | 0.013 | 42 | 0.179 | 0.51 | absence | 1.59 |
| | 16 | " | 8 | " | 2.66 | 0.61 | 0.35 | 0.0091 | 49 | 0.735 | 2.1 | absence | 1.58 |
| | 17 | " | 10 | " | 2.68 | 0.60 | 0.36 | 0.0064 | 56 | 1.12 | 8.2 | absence | 1.52 |
| | 18 | " | 12 | " | 2.67 | 0.58 | 0.42 | 0.0060 | 50 | 1.33 | 3.8 | absence | 1.55 |
| | 19 | " | 15 | " | 2.65 | 0.54 | 0.51 | 0.0055 | 42 | 1.44 | 4.1 | absence | 1.48 |
| | 20 | " | 20 | " | 2.67 | 0.51 | 0.65 | 0.0051 | 52 | 1.68 | 4.8 | absence | 1.53 |
| | 21 | " | 30 | " | 2.67 | 0.49 | 0.71 | 0.0044 | 58 | 2.20 | 6.3 | absence | 1.58 |
| | 22 | " | 50 | " | 2.66 | 0.48 | 0.75 | 0.0034 | 45 | 2.73 | 7.8 | absence | 1.59 |
| | 23 | " | 75 | " | 2.65 | 0.47 | 0.81 | 0.0028 | 53 | 4.38 | 12.5 | absence | 1.72 |
| | 24 | " | 100 | " | 2.66 | 0.42 | 0.83 | 0.0020 | 55 | 5.39 | 15.4 | absence | 1.83 |
| Comparative examples | 25 | G | 3 min. | " | 3.49 | 0.30 | 0.98 | <0.0001 | 2.3 | 0.21 | 0.6 | absence | 2.36 |

Primary components of the decarburization accelerator employed: 48% by weight $Al_2O_3$ – 51% by weight $SiO_2$.

Example 3

A steel D ingot shown in Table 1 was hot-forged to prepare steel plates each having a thickness of 60 mm, after which the steel plates were hot-rolled to prepare steel sheets each having a different thickness ranging from 5 mm to 2 mm. Subsequently, the steel sheets were acid cleaned and then cold-rolled to the same thickness of 0.35 mm. The resultant steel sheets had a width of 300 mm. From the resultant cold-rolled steel sheets, test sheets each having a size of 250 mm (width)×600 mm (length) were obtained, and these test sheets were subjected to final annealing described below.

Fibrous decarburization accelerators containing 35 wt % $Al_2O_8$–65 wt % $SiO_2$ and demanganization powder accelerator containing $TiO_2$ were placed, as separators, between layers of the test sheets to achieve a density of 0.01 g/cm$^2$ for the decarburization accelerators and a density of 0.002 g/cm$^2$ for the demanganization powder accelerator. The thus prepared layered body was heated to a temperature of 1000° C. at a temperature rise rate of 1° C./min and then soaked at the temperature for 8 hours in a vacuum of 1 Torr.

The same Comparative Example as that used in Example 2 was used.

The test sheets were analyzed to obtain chemical composition, average grain diameter, density ratio of {100} planes parallel to the surface of the sheet, Mn concentration, and magnetic characteristics. In order to use as samples for analyzing magnetic characteristics, strips each measuring 30 mm wide×100 mm long was cut out from each of the test sheets in such a manner that an angle of the longer side of each strip from the direction of rolling was varied at a pitch of 5°. These strips were then annealed in a nitrogen gas atmosphere at 800° C. for 1 hour to remove strain caused by cutting. Then, the strips were analyzed to obtain magnetic characteristics (magnetic flux density and core loss) in a direction of the longer side thereof, using a single-plate magnetic analyzer.

FIG. 3(*b*) shows the dependency of core loss $W_{10/50}$ on a direction when the Invention and Comparative Examples are magnetized to 1.0 T in an alternating magnetic field of 50 Hz. As seen from FIG. 3(*b*), Invention Examples Nos. 26 to 29 show a smaller dependency of core loss on a direction and a smaller absolute value of core loss as compared with the Comparative Example.

FIG. 4 shows a {100} pole chart of Invention Example No. 27 obtained by X-ray diffraction. As seen from FIG. 4, a near {100} <021> crystallographic texture has developed. The developed near {100} <021 crystallographic texture causes <101> axes to disperse in 8 directions within the surface of the sheet, resulting in a small dependency of magnetic flux density on a direction at a magnetizing force of 1000 A/m and a small dependency of core loss on a direction.

TABLE 4

| No. | | | | 26 | 27 | 28 | 29 | 30 |
|---|---|---|---|---|---|---|---|---|
| | Steel | | | D | D | D | D | G |
| Cold rolling | Thickness of the steel plate before rolling | | mm | 2.0 | 3.0 | 4.0 | 5.0 | 3.0 |
| | Thickness of the steel plate after rolling | | mm | 0.35 | 0.35 | 0.35 | 0.35 | 0.35 |
| | Reduction | | % | 82.5 | 88.3 | 91.3 | 93.0 | 88.3 |
| Composition | C | | ppm | 25 | 25 | 25 | 25 | 20 |
| | Si | | % | 3.01 | 3.00 | 3.02 | 3.01 | 3.5 |
| | Mn | | % | 0.68 | 0.67 | 0.68 | 0.69 | 0.3 |
| Mn concentration | Mn Concentration in the surface | | % | 0.49 | 0.51 | 0.48 | 0.50 | 0.3 |
| | Mn Concentration ration in the surface | | | 0.61 | 0.63 | 0.59 | 0.60 | 0.99 |
| | Maximum ratio of reduction | | %/μm | 0.007 | 0.007 | 0.007 | 0.007 | <0.0001 |
| Density ratio of (100) planes parallel to the surface of sheet | | | | 48 | 56 | 53 | 45 | 2.3 |
| Average grain size vs. sheet thickness (ratio) after annealing | | | | 2.7 | 2.5 | 3.1 | 3.4 | 0.6 |
| Properties after annealing | Presence or absence of abnormal magnetization | | | absence | absence | absence | absence | absence |
| | Core loss $W_{10/50}$ | | W/kg | 0.62 | 0.61 | 0.59 | 0.58 | 1.12 |
| | Magnetic flux density | Maximum value A | T | 1.635 | 1.647 | 1.663 | 1.664 | 1.558 |
| | | Minimum value B | T | 1.537 | 1.536 | 1.543 | 1.542 | 1.408 |
| | | Maximum deviation A-B | T | 0.098 | 0.116 | 0.120 | 0.122 | 0.150 |
| | | Average value of all the directions C | T | 1.586 | 1.593 | 1.602 | 1.604 | 1.450 |
| | | (A − B)/C | | 0.062 | 0.073 | 0.075 | 0.076 | 0.103 |

Each of the test sheets shows a C content (after annealing) of not more than 0.0025 wt % and the average Mn concentration of 0.68 wt % , indicating no abnormal rise of magnetic flux density in a low magnetic field.

FIGS. 3(*a*) and 3(*b*) show measurements of magnetic flux density and core loss which were obtained from the above-mentioned strips by analysis using a single-plate magnetic analyzer. FIG. 3(*a*) shows the result of measuring the magnetic flux density of test sheet No. 27, which was prepared by cold rolling a steel sheet having a thickness of 3 mm to 0.35 mm and subjecting the cold-rolled sheet to final annealing. In this measurement, test sheet No. 27 was magnetized by a magnetizing force of 1000 A/m, and its magnetic flux density was measured in directions which are inclined from the direction of rolling at a pitch of 15°. An average value of magnetic flux density $B_{10}$ is about 1.6 T (Tesla). The ratio of the difference (maximum deviation, 0.116 T) between a maximum value (1.647 T) of $B_{10}$ and a minimum value (1.536 T) of $B_{10}$ to the average value (1.593 T) of $B_{10}$ is 0.073. By contrast, in the Comparative Example which was magnetized at a magnetizing force of 1000 A/m, the average value of magnetic flux density $B_{10}$ is about 1.45 T, and the ratio of the difference (0.15 T) between a maximum value (1.558 T) of $B_{10}$ and a minimum value (1.408 T) of $B_{10}$ to the average value (1.45 T) of $B_{10}$ is 0.103. As a result of comparing Invention Examples Nos. 26 to 29 with the Comparative Example, which are all magnetized at a magnetizing force of 1000 A/m, in the manner described above, Invention Examples Nos. 26 to 29 show a smaller dependency of magnetic flux density on a direction as compared with the Comparative Example. In addition, the average magnetic flux density of the Invention Examples is 0.15 T higher than that of the Comparative Example.

Example 4

A steel D ingot shown in Table 1 was hot-forged to prepare steel plates each having a thickness of 60 mm, after which the steel plates were hot-rolled to prepare steel sheets having a thickness of 4 mm. Subsequently, the steel sheets were acid cleaned and then cold-rolled (first-stage cold rolling) to prepare steel sheets each having a different thickness ranging from 2.5 mm to 1.0 mm. The thus obtained steel sheets were subjected to intermediate annealing at a temperature of 900° C. for 2 minutes in a nitrogen gas atmosphere.

Then, the steel sheets each having a different thickness were again cold-rolled (second-stage cold rolling) to a thickness of 0.3 mm. The resultant steel sheets had a width of 300 mm. From the resultant cold-rolled steel sheets, test sheets each having a size of 250 mm (width)×600 mm (length) were obtained, and these test sheets were subjected to final annealing under conditions similar to those described in Example 3.

The test sheets were analyzed in a manner similar to that described in Example 3 to obtain chemical composition, average grain diameter, density ratio of {100} planes parallel to the surface of the sheet, Mn concentration, and dependency of magnetic flux density on a direction. The results of this analysis are shown in Table 5. Taking magnetic flux density $B_{10}$ in the direction of rolling within the plane of rolling as X2, magnetic flux density $B_{10}$ in the width direction of the sheet as X2, average of magnetic flux densities in the direction of rolling and in the width direction of the sheet (X1+X2)/2 as X, and magnetic flux density $B_{10}$ in a direction inclined 45° away from the direction of rolling as Y, the following value was calculated.

$$2(X-Y)/(X+Y)$$

The results of the above calculation are shown in Table 5.

Invention Examples Nos. 31 to 84 which had undergone cold-rolling twice show a 2(X−Y)/(X+Y) value of 0.175–0.306, which is greater than that, 0.050, of the Comparative Example. This indicates that Invention Examples Nos. 31 to 84 have plane anisotropy regarding magnetic flux density, thus providing doubly oriented magnetic steel sheets.

(width)×600 mm (length) were obtained, and these test sheets were subjected to final annealing described below.

Fibrous decarburization accelerators containing 48 wt % $Al_2O_3$–52 wt % $SiO_2$ and demanganization powder accelerator containing $TiO_2$ were placed, as separators, between layers of the test sheets to achieve a density of 0.01 g/cm$^2$ for the decarburization accelerators and a density of 0.002 g/cm$^2$ for the demanganization powder accelerator. The thus prepared layered body was heated to a temperature of 1030° C. at a temperature rise rate of 0.7° C./min and then soaked at the temperature for 15 hours in a vacuum of $10^{-2}$ Torr. After the final annealing, a phosphate solution was applied to part of the test sheets, followed by baking at a temperature of 600° C. The subsequent contraction due to cooling causes an isotropic tension of 1 kg/mm$^2$ to be applied within the surface of the sheet.

TABLE 5

| No. | | | | 26 | 27 | 28 | 29 | 30 |
|---|---|---|---|---|---|---|---|---|
| | Steel | | | D | D | D | D | G |
| Cold rolling | First stage | Thickness of the steel plate before rolling | mm | 4.0 | 4.0 | 4.0 | 4.0 | 3.0 |
| | | Thickness of the steel plate after rolling | mm | 2.5 | 2.0 | 1.5 | 1.0 | 0.35 |
| | | Reduction | % | 37.5 | 50.0 | 62.5 | 75.0 | 88.3 |
| | Second stage | Thickness of the steel plate before rolling | mm | 2.5 | 2.0 | 1.5 | 1.0 | — |
| | | Thickness of the steel plate after rolling | mm | 0.3 | 0.3 | 0.3 | 0.3 | — |
| | | Reduction | % | 88.0 | 85.0 | 80.0 | 70.0 | — |
| Composition | C | | ppm | <25 | <25 | <25 | <25 | <25 |
| | Si | | % | 3.01 | 3.00 | 2.99 | 3.01 | 3.5 |
| | Mn | | % | 0.64 | 0.63 | 0.65 | 0.63 | 0.3 |
| Mn concentration | Mn Concentration in the surface | | % | 0.43 | 0.47 | 0.48 | 0.46 | 0.3 |
| | Mn Concentration ratio in the surface | | | 0.67 | 0.65 | 0.66 | 0.64 | 0.99 |
| | Maximum ratio of reduction | | %/μm | 0.006 | 0.006 | 0.006 | 0.006 | <0.0001 |
| Average grain size vs. sheet thickness (ratio) | | | | 3.1 | 2 | 5.3 | 6.1 | 0.6 |
| Density ratio of (100) planes parallel to the surface of sheet | | | | 53 | 42 | 63 | 56 | 2.3 |
| Properties after annealing | Presence or absence of abnormal magnetization | | | absence | absence | absence | absence | absence |
| | Magnetic flux density | Rolling direction X1 | T | 1.752 | 1.775 | 1.792 | 1.859 | 1.558 |
| | | Direction of the width of plate X2 | T | 1.732 | 1.751 | 1.790 | 1.845 | 1.428 |
| | | 45° direction Y | T | 1.462 | 1.442 | 1.416 | 1.360 | 0.420 |
| | | Average value of X1 and X2 | T | 1.742 | 1.763 | 1.791 | 1.852 | 1.493 |
| | | 2(X − Y)/(X + Y) | | 0.175 | 0.200 | 0.234 | 0.306 | 0.050 |

Example 5

A steel H ingot shown in Table 1 was hot-forged to prepare steel plates each having a thickness of 60 m, after which the steel plates were hot-rolled to prepare steel sheets each having a thickness of 2.3 mm. Subsequently, the steel sheets were acid cleaned and then cold-rolled to a thickness of 0.35 mm at a reduction ratio of 85%. The resultant steel sheets had a width of 300 mm. From the resultant cold-rolled steel sheets, test sheets each having a size of 250 mm The test sheets were analyzed in a manner similar to that described in Example 3 to obtain chemical composition, average crystal grain diameter, density ratio of {100} planes parallel to the surface of the sheet, Mn concentration, and dependency of magnetic characteristics (magnetic flux density and core loss) on a direction. The results of this analysis are shown in Table 6.

TABLE 6

| Tested plates | | | Absence of addition of a tension | Presence of addition of a tension | *Reference example |
|---|---|---|---|---|---|
| Steel | | | H | H | — |
| Cold rolling | Thickness of the steel plate before rolling | mm | 2.3 | 2.3 | — |
| | Thickness of the steel plate after rolling | mm | 0.35 | 0.35 | — |
| | Reduction | % | 85 | 85 | — |
| Composition | C | ppm | <25 | <25 | — |
| | Si | % | 2.92 | 2.92 | — |

TABLE 6-continued

| Tested plates | | | | Absence of addition of a tension | Presence of addition of a tension | *Reference example |
|---|---|---|---|---|---|---|
| Mn concentration | Mn | | % | 0.56 | 0.56 | — |
| | Mn Concentration in the surface | | % | 0.46 | 0.46 | — |
| | Mn Concentration ratio in the surface | | | 0.71 | 0.71 | — |
| | Maximum ratio of reduction | | %/μm | 0.003 | 0.003 | — |
| Density ratio of (100) planes parallel to the surface of sheet | | | | 58 | 58 | 1.9 |
| Average grain size vs. sheet thickness (ratio) after annealing | | | | 2.1 | 2.1 | — |
| Properties after annealing | Presence or absence of abnormal magnetization | | | absence | absence | absence |
| | Core loss | | W/kg | 0.56 | 0.49 | 0.98 |
| | Magnetic flux density | Maximum value A | T | 1.636 | 1.636 | 1.565 |
| | | Minimum value B | T | 1.564 | 1.564 | 1.423 |
| | | Maximum deviation A − B | T | 0.072 | 0.072 | 0.142 |
| | | Average value of all the directions C | T | 1.597 | 1.597 | 1.495 |
| | | (A − B)/C | | 0.045 | 0.045 | 0.095 |

*Reference example: Data of a commercially available high grade nonoriented magnetic steel sheet Any of the tension-applied and tension-free test sheets shows a C content of not more than 0.0025 wt % and the average Mn concentration of 0.56 wt %, indicating no abnormal rise of magnetic flux density in a low magnetic field.

An average value of magnetic flux density $B_{10}$ is about 1.597 T (Tesla). The ratio of the difference (maximum deviation, 0.072 T) between a maximum value (1.636 T) of $B_{10}$ and a minimum value (1.564 T) of $B_{10}$, to the average value (1.597 T) of $B_{10}$ is 0.045. This indicates that the dependency of magnetic flux density on a direction is quite small. The effect of applying a tension is proved by a measured core loss. In other words, by applying a tension, core loss reduces.

For reference, Table 6 contains magnetic characteristics of a commercial high grade non-oriented magnetic steel sheet having a thickness of 0.35 mm. As compared with the Reference Example, a magnetic steel sheet of the present invention provides a higher magnetic flux density, a smaller dependency of magnetic flux density on a direction, and a smaller core loss. Thus, the present invention provides a non-oriented magnetic steel sheet having excellent magnetic characteristics.

Example 6

A steel H ingot shown in Table 1 was hot-forged to prepare steel plates each having a thickness of 20 mm, after which the steel plates were hot-rolled to prepare steel sheets having a thickness of 2.3 mm. Subsequently, the steel sheets were acid cleaned and then cold-rolled (first-stage cold rolling) at a reduction ratio of 56.5% to a thickness of 1.0 mm. The thus obtained steel sheets were subjected to intermediate annealing at a temperature of 900° C. for 1 minutes in a nitrogen gas atmosphere. Then, the steel sheets were again cold-rolled (second-stage cold rolling) at a reduction ratio of 70.0% to a thickness of 0.3 mm. The resultant steel sheets had a width of 300 mm. From the resultant cold-rolled steel sheets, test sheets each having a size of 250 mm (width)×600 mm (length) were obtained, and these test sheets were subjected to final annealing under conditions similar to those described in Example 5.

The test sheets were analyzed in a manner similar to that described in Example 3 to obtain chemical composition, average grain diameter, density ratio of {100} planes parallel to the surface of the sheet, Mn concentration, and dependency of magnetic flux density on a direction. The results of this analysis are shown in Table 7. In order to confirm the effect of applying a tension, a tension of up to 12 kg/mm$^2$ was mechanically applied to a test sheet in the direction of magnetization when magnetic characteristics were measured using a single-strip magnetic analyzer.

Any of the tension-applied and tension-free test sheets shows a C content of not more than 0.002 wt % and the average Mn concentration of 0.57 wt %, indicating no abnormal rise of magnetic flux density in a low magnetic field.

As described in Example 4, in order to confirm the dependency of magnetic flux density on a direction from measurements of magnetic characteristics, the following calculation was performed. Taking magnetic flux density $B_{10}$ in the direction of rolling as X1, magnetic flux density $B_{10}$ in the width direction of the sheet as X2, average of magnetic flux densities in the direction of rolling and in the width direction of the sheet (X1+X2)/2 as X, and magnetic flux density $B_{10}$ in a direction inclined 45° away from the direction of rolling as Y, 2(X−Y)/(X+Y) was calculated. Results of the calculation are shown in Table 7. As seen from Table 7, any of the Invention Examples shows a large value of 0.244 obtained by the calculation. This indicates that the Invention Examples have plane anisotropy regarding magnetic flux density, thus providing doubly oriented magnetic steel sheets.

TABLE 7

| Tested plates | | | | Examples of the present invention | | | | *Reference example |
|---|---|---|---|---|---|---|---|---|
| Tension added Kg/mm$^2$ | | | | 0.0 | 0.4 | 0.8 | 1.0 | — |
| Cold rolling | First stage | Thickness of the steel plate before rolling | mm | 2.3 | 2.3 | 2.3 | 2.3 | — |
| | | Thickness of the steel plate after rolling | mm | 1.0 | 1.0 | 1.0 | 1.0 | — |

TABLE 7-continued

| Tested plates | | | | Examples of the present invention | | | | *Reference example |
|---|---|---|---|---|---|---|---|---|
| | | Reduction | % | 56.5 | 56.5 | 56.5 | 56.5 | — |
| | Second stage | Thickness of the steel plate before rolling | mm | 1.0 | 1.0 | 1.0 | 1.0 | — |
| | | Thickness of the steel plate after rolling | mm | 0.3 | 0.3 | 0.3 | 0.3 | — |
| | | Reduction | % | 70.0 | 70.0 | 70.0 | 70.0 | — |
| Composition | C | | ppm | <25 | <25 | <25 | <25 | — |
| | Si | | % | 2.92 | 2.92 | 2.92 | 2.92 | — |
| | Mn | | % | 0.57 | 0.57 | 0.57 | 0.57 | — |
| Mn concentration | Mn Concentration in the surface | | % | 0.48 | 0.48 | 0.48 | 0.48 | — |
| | Mn Concentration ratio in the surface | | | 0.73 | 0.73 | 0.73 | 0.73 | — |
| | Maximum ratio of reduction | | %/μm | 0.003 | 0.008 | 0.003 | 0.003 | — |
| Average grain size vs. sheet thickness (ratio) | | | | 2.4 | 2.4 | 2.4 | 2.4 | >30 |
| Density of (100) planes parallel to the surface of sheet | | | | 63 | 63 | 63 | 63 | 0 |
| Properties after annealing | Presence or absence of abnormal magnetization | | | absence | absence | absence | absence | absence |
| | Core loss | **$W_{15/50}$ | W/kg | 0.92 | 0.79 | 0.70 | 0.71 | 0.75 |
| | | **$W_{17/50}$ | W/kg | 1.31 | 1.06 | 0.97 | 0.96 | 1.01 |
| | Magnetic flux density | Rolling direction X1 | T | 1.82 | 1.82 | 1.82 | 1.82 | 1.91 |
| | | Direction of the width of plate X2 | T | 1.81 | 1.81 | 1.81 | 1.81 | 1.38 |
| | | 45° direction Y | T | 1.42 | 1.42 | 1.42 | 1.42 | 1.24 |
| | | Average value of X1 and X2 X | T | 1.815 | 1.815 | 1.815 | 1.815 | 1.645 |
| | | 2(X − Y)/(X + Y) | | 0.244 | 0.244 | 0.244 | 0.244 | 0.280 |

*Reference Example: Data of a commercially available high grade nonoriented magnetic steel sheet
**Core losses ($W_{15/50}$, $W_{17/50}$) are average values of data in the rolling direction and in the width direction of sheet In order to confirm the effect of applying a tension, Table 7 shows measured values of core losses $W_{15/50}$ and $W_{17/50}$ for the Invention Examples, where a tension of up to 1.0 kg/mm$^2$ is applied, and for the Reference Example, where no tension is applied. The measurements show that by applying a tension, core loss reduces.

Figure 5:
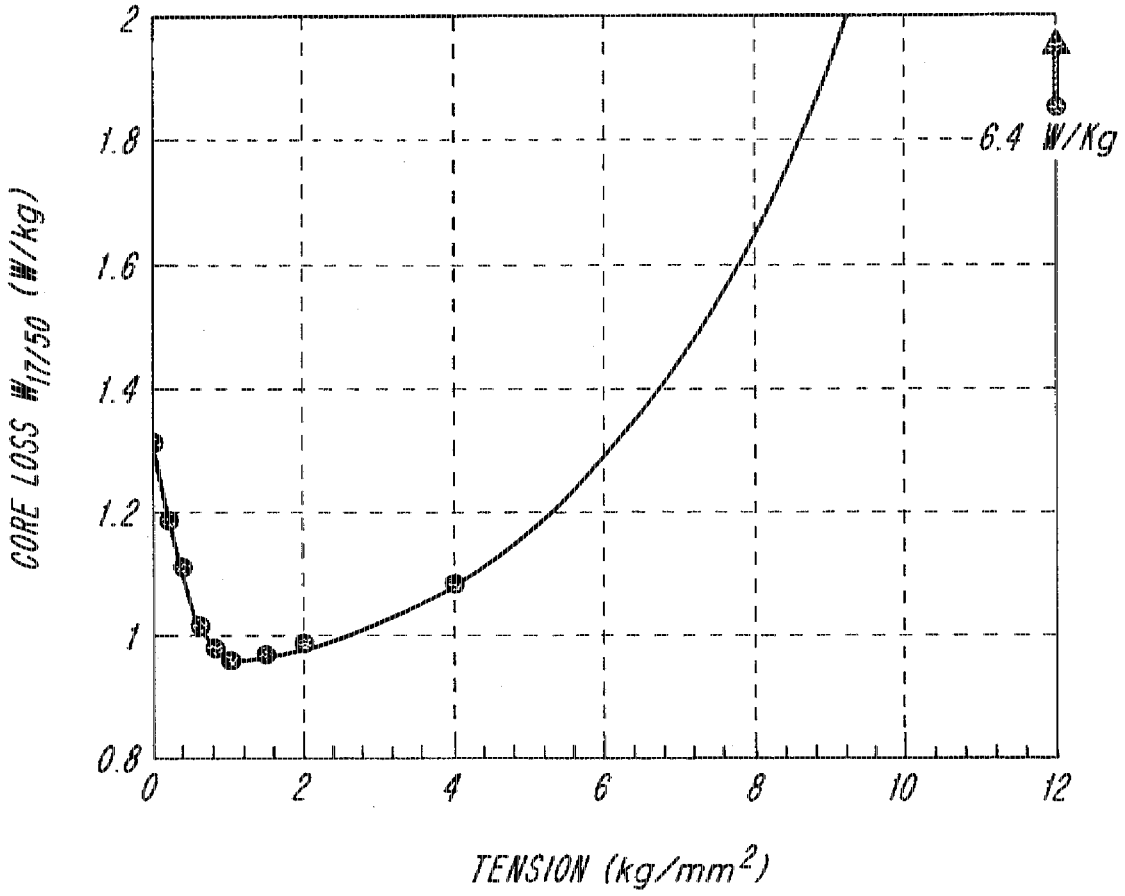
FIG. 5 is a graph showing the relationship between a tension applied in a magnetizing direction and core loss ($W_{17/50}$), in a steel sheet which has undergone final annealing.

FIG. 5 shows the relationship between a tension applied to a test sheet in the direction of magnetization and core loss $W_{17/50}$. As seen from FIG. 5, by applying a tension of 0.1 kg/mm$^2$ or more, core loss can be reduced. However, a tension is too large, magnetic characteristics tend to degrade. Accordingly, the upper limit of a tension to be applied is preferably 5 kg/mm$^2$, more preferably 3 kg/mm$^2$. FIG. 5 shows that when a tension applied increases to 10 kg/mm$^2$ through 12 kg/mm$^2$, core loss increases sharply (for example, core loss becomes 6.4 W/kg at an applied tension of 12 kg/mm$^2$. This is because an excess tension brings about a plastic strain.

For reference Table 7 contains magnetic characteristics in the direction of rolling of a commercial singly oriented silicon steel sheet. As compared with the Reference Example, a doubly oriented magnetic steel sheet of the present invention has a greater magnetic flux density and a smiler core loss in the direction of rolling and in the width direction of the sheet. Particularly, when an appropriate tension is applied, the core loss ($W_{15/50}$, $W_{17/50}$) of the Invention Examples is better than that in the direction of rolling of the Reference Example.

What is claimed:

1. A magnetic steel sheet having excellent magnetic characteristics and blanking performance comprising a) 0.2 to 6.5% by weight of Si and 0.03 to 2.5% by weight of Mn as alloy components; and having b) a crystallographic texture wherein the density of aggregation of {100} planes parallel to the surface of the sheet is not less than 10 times that of non-oriented crystal grains, and c) a demanganized layer in which the concentration of manganese decreases from the interior of the sheet toward the surface of the sheet, wherein d) the ratio of the concentration of manganese in the surface portion of the sheet to that in the mid depth portion of the sheet is not more than 0.90, and e) the maximum ratio of reduction in the concentration of manganese within the demanganized layer is not more than 0.05 wt % /μm.

2. A magnetic steel sheet according to claim 1, having a crystallographic texture wherein the density of aggregation of {100} planes parallel to the surface of the sheet is not less than 20 times that of non-oriented crystal grains.

3. A magnetic steel sheet according to claim 1, wherein the ratio of the concentration of manganese in the surface portion of the sheet to that in the mid depth portion of the sheet is not more than 0.80.

4. A magnetic steel sheet according to claim 1, wherein the maximum ratio of reduction in the concentration of manganese within the demanganized layer is not more than 0.03 wt %/μm.

5. A non-oriented magnetic steel sheet according to claim 1, wherein the value (A−B)/C is equal to or smaller than 0.15, where A and B are maximum and minimum values, respectively, of magnetic flux densities $B_{10}$ measured omnidirectionally within the sheet plane with a magnetizing force of 1000 A/m; (A−B) is a maximum deviation between maximum value A and minimum value B; and C is the average value of magnetic flux densities $B_{10}$ measured.

6. A doubly oriented magnetic steel sheet according to claim 1, wherein the ratio 2(X−Y)/(X+Y) obtained by dividing the difference between X and Y, i.e., (X−Y), by the average of X and Y, i.e., by (X+Y)/2, is not less than 0.16, where X is the average of X1 and X2 ((X1+X2)/2), X1 is magnetic flux density $B_{10}$ in the direction of rolling, X2 is magnetic flux density $B_{10}$ in the width direction of the sheet, and Y is magnetic flux density $B_{10}$ in a direction which is 45° away from the direction of rolling when a magnetizing force of 1000 k/m is applied.

7. A magnetic steel sheet having excellent magnetic characteristics and blanking performance comprising a) 0.2 to 6.5% by weight of Si and 0.03 to 2.5% by weight of Mn as alloy components; and having b) a crystallographic texture wherein the density of aggregation of {100} planes parallel to the surface of the sheet is not less than 10 times that of non-oriented crystal grains, and c) a demanganized layer in which the concentration of manganese decreases from the interior of the sheet toward the surface of the sheet, wherein d) the ratio of the concentration of manganese in the surface portion of the sheet to that in the mid depth portion of the sheet is not more than 0.90, and e) the maximum ratio of reduction in the concentration of manganese within the demanganized layer is not more than 0.05 wt % /μm, and f) the average diameter of crystal grains is 0.25 to 10 times the thickness of the sheet.

8. A magnetic steel sheet according to claim 7, having a crystallographic texture wherein the density of aggregation of {100} planes parallel to the surface of the sheet is not less than 20 times that of non-oriented crystal grains.

9. A magnetic steel sheet according to claim 7, wherein the ratio of the concentration of manganese in the surface portion of the sheet to that in the mid depth portion of the sheet is not more than 0.80.

10. A magnetic steel sheet according to claim 7, wherein the maximum ratio of reduction in the concentration of manganese within the demanganized layer is not more than 0.03 wt %/μm.

11. A magnetic steel sheet according to claim 7, wherein the thickness of the sheet is not greater than 5.0 mm.

12. A non-oriented magnetic steel sheet according to claim 7, wherein the value (A−B)/C is equal to or smaller than 0.15, where A and B are maximum and minimum values, respectively, of magnetic flux densities $B_{10}$ measured omnidirectionally within the sheet plane with a magnetizing force of 1000 A/m; (A−B) is a maximum deviation between maximum value A and minimum value B; and C is the average value of magnetic flux densities $B_{10}$ measured.

13. A doubly oriented magnetic steel sheet according to claim 7, wherein the ratio 2(X−Y)/(X+Y) obtained by dividing the difference between X and Y, i.e., (X−Y), by the average of X and Y, i.e., by (X+Y)/2, is not less than 0.16, where X is the average of X1 and X2((X1+X2)/2), is magnetic flux density $B_{10}$ in the direction of rolling, X2 is magnetic flux density $B_{10}$ in the width direction of the sheet, and Y is magnetic flux density $B_{10}$ in a direction which is 45° away from the direction of rolling when a magnetizing force of 1000 A/m is applied.

14. A magnetic steel sheet having excellent magnetic characteristics and blanking performance comprising a) 0.2 to 6.5% by weight of Si and 0.03 to 2.5% by weight of Mn as alloy components; and having b) a crystallographic texture wherein the density of aggregation of {100} planes parallel to the surface of the sheet is not less than 10 times that of non-oriented crystal grains, and c) a demanganized layer in which the concentration of manganese decreases from the interior of the sheet toward the surface of the sheet, wherein d) the ratio of the concentration of manganese in the surface portion of the sheet to that in the mid depth portion of the sheet is not more than 0.90%, and e) the maximum ratio of reduction in the concentration of manganese within the demanganized layer is not more than 0.05 wt %/μm, and f) a tension smaller than the elastic limit of the sheet is applied to the sheet parallel to the surface of the sheet.

15. A magnetic steel sheet according to claim 14, having a crystallographic texture wherein the density of aggregation of {100} planes parallel to the surface of the sheet is not less than 20 times that of non-oriented crystal grains.

16. A magnetic steel sheet according to claim 14, wherein the ratio of the concentration of manganese in the surface portion of the sheet to that in the mid depth portion of the sheet is not more than 0.80.

17. A magnetic steel sheet according to claim 14, wherein the maximum ratio of reduction in the concentration of manganese within the demanganized layer is not more than 0.03 wt %/μm.

18. A magnetic steel sheet according to claim 14, wherein the tension applied to the sheet parallel to the surface of the sheet is between 0.1 $kg/mm^2$ and 5 $kg/mm^2$.

19. A non-oriented magnetic steel sheet according to claim 14, wherein the value (A−B)/C is equal to or smaller than 0.15, where A and B are maximum and minimum values, respectively, of magnetic flux densities $B_{10}$ measured omnidirectionally within the sheet plane with a magnetizing force of 1000 A/m: (A−B) is a maximum deviation between maximum value A and minimum value B: and C is the average value of magnetic flux densities $B_{10}$ measured.

20. A doubly oriented magnetic steel sheet according to claim 14, wherein the ratio 2(X−Y)/(X+Y) obtained by dividing the difference between X and Y, i.e., (X−Y), by the average of X and Y, i.e., by (X+Y)/2, is not less than 0.16, where X is the average of X1 and X2 ((X1+X2)/2), X1 is magnetic flux density $B_{10}$ in the direction of rolling, X2 is magnetic flux density $B_{10}$ in the width direction of the sheet, and Y is magnetic flux density $B_{10}$ in a direction which is 45° away from the direction of rolling when a magnetizing force of 1000 A/m is applied.

* * * * *